United States Patent [19]

Nordmeyer

[11] Patent Number: 4,842,315

[45] Date of Patent: Jun. 27, 1989

[54] SKI CARRIER

[75] Inventor: Robert Nordmeyer, Woodland Hills, Calif.

[73] Assignee: Ski Tote USA, Canoga Park, Calif.

[21] Appl. No.: 119,736

[22] Filed: Nov. 12, 1987

[51] Int. Cl.[4] ..... A63C 11/02

[52] U.S. Cl. ..... 294/147; 294/143; 294/165

[58] Field of Search ..... 294/147, 146, 138, 143, 294/149, 152, 156, 157, 161, 162, 163, 165; 224/917; 280/814, 815

[56] References Cited

U.S. PATENT DOCUMENTS 3,877,623 4/1975 Breault ..... 294/147
3,892,343 7/1975 Warner ..... 294/147
4,491,359 7/1985 Metropulos ..... 294/147
4,494,787 1/1985 Gainey ..... 294/147

*Primary Examiner*—James B. Marbert
*Attorney, Agent, or Firm*—Ladas & Parry

[57] ABSTRACT

A ski carrier for carrying a pair of skis and a pair of ski poles using a single hand. The carrier has a pair of generally "L" shaped arms which are articulated to each other and a pair of yoke members, each one of which is articulated to one of the arms. A pair of pole clips are articulated to each yoke for carrying a skier's poles. A strap is associated with the pair of yokes for encircling a pair of skis, the straps carrying a pair of skis when the free ends of the straps are locked by a manually operated locking device.

20 Claims, 5 Drawing Sheets

SKI CARRIER

BACKGROUND OF THE INVENTION

This invention relates to carriers for carrying skies. Ski carriers are very well known in the art and they tend either to be sufficiently bulky that they cannot be easily carried on a skier's clothing, for example, or they are insufficiently rigid to adequately support the skies.

It is, therefore, one object of the invention to provide a device which is compact enough that it can be easily carried, yet strong enough that it can adequately support a pair of skies and poles, and permit the skis and poles to be easily carried by using the device.

BRIEF DESCRIPTION OF THE INVENTION

Briefly, and in general terms, the present invention provides a ski carrier which has a pair of generally "L" shaped arms which are articulated to each other and a pair of yoke members, each one of which is articulated to one of the arms. A pair of pole clips are articulated to each yoke for carrying a skier's poles. A strap is associated with the pair of yokes for encircling a pair of skies, the straps carrying a pair of skis when the free ends of the straps are locked by a manually operated locking device. The ski carrier can be collapsed by moving the various articulated joints so that it can be easily carried on one's person when not actively used to carry skis and poles.

DETAILED DESCRIPTION OF THE INVENTION

Figure 1:
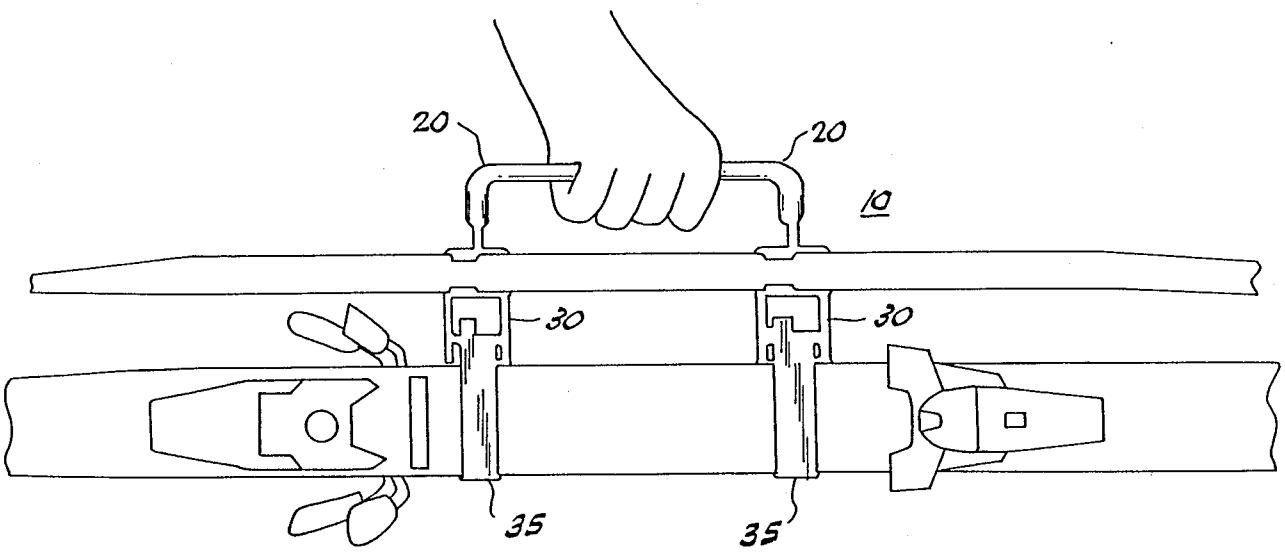
FIG. 1 depicts a person carrying a pair of skis and an associated pair of ski poles using the ski carrier.
Figure 7:
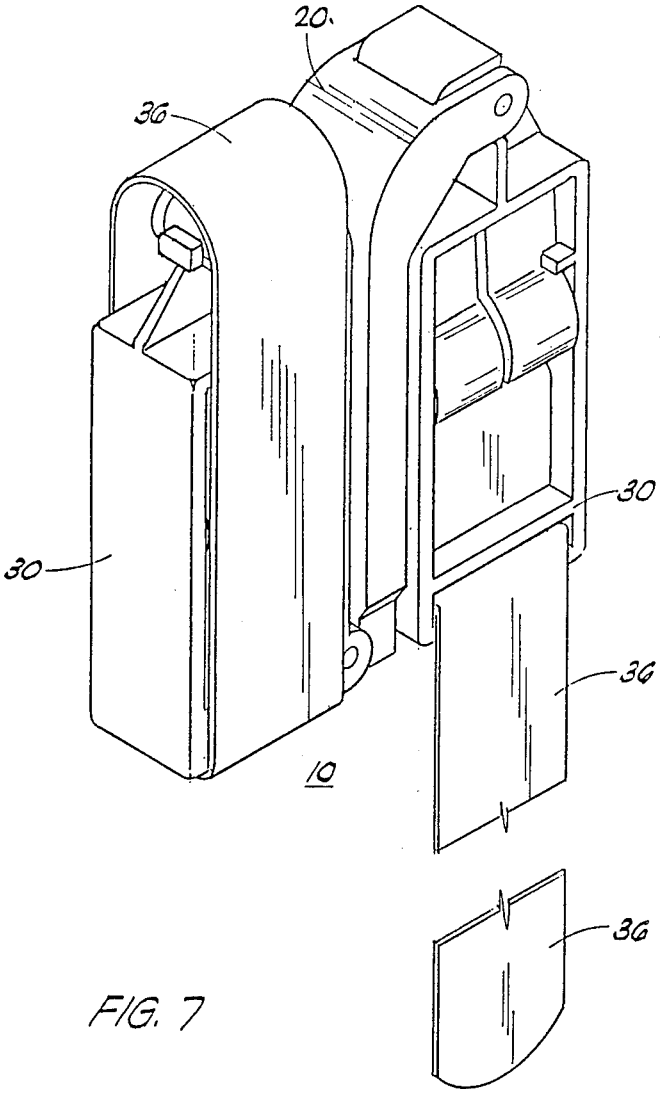
FIG. 7 shows the ski carrier in its collapsed configuration.

FIG. 1 depicts a person carrying a pair of skis and an associated pair of ski poles using the ski carrier of the present invention, which carrier will now be described in greater detail. The ski carrier permits a person to carry a pair of skis and a pair of poles with a single hand. Also, as will be seen, the ski carrier may be collapsed for easy transport or for easy storage. That is, the collapsed ski carrier occupies a space of approximately $1\times3\frac{1}{2}\times3\frac{3}{4}$ inches and therefore can be easily carried in a pocket of the user's clothing, in a back pack, in a bag on in any other convenient place. the collapsed configuration of the carrier 10 is shown in FIG. 7.

Figure 2:
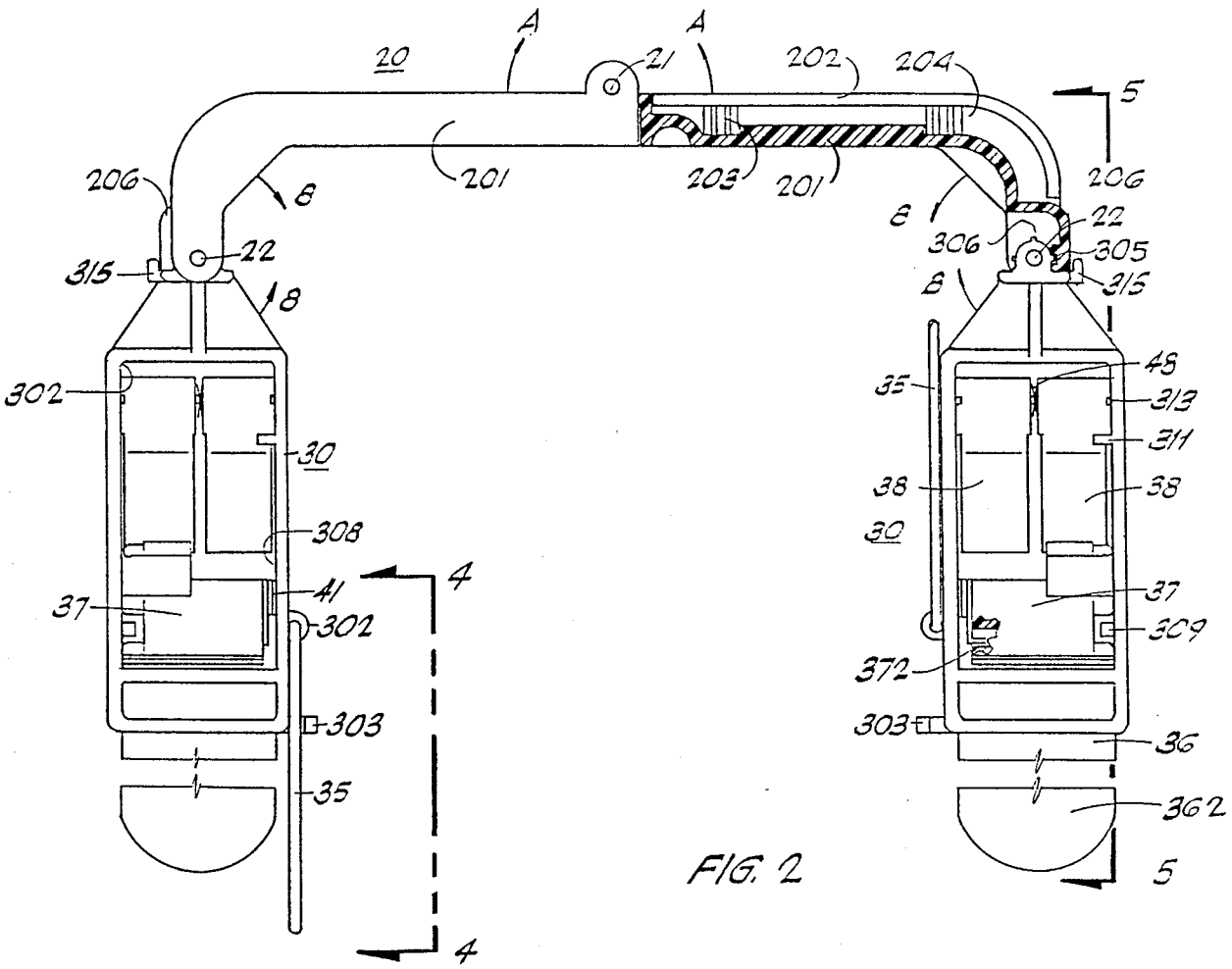
FIG. 2 is a partially cut away side elevational view of the ski carrier.

FIG. 2 is a partially cut away side elevational view of the ski carrier in its expanded configuration, that is, the configuration which it takes when used to transport skis and poles. The ski carrier includes a pair of arms 20, which arms are preferably identical to each other and therefore interchangeable with each during the manufacture of carrier 10. The right hand arm 20 is shown as a cut away view to depict its internal construction. The arms 20 are articulated to each other on a pin 21 and are arranged to rotate on pin 21 in the direction of arrows A so as to bring arms 20 into a confronting relationship when carrier 10 is collapsed as shown in FIG. 7.

As can be seen in FIG. 2, each arm 20 has a "L" shape and the arms are articulated to each other adjacent the longer sides of the "L". On the shorter side of each "L" of arms 20 is attached a yoke 30. Each yoke 30 is articulated on a pin 22 for rotation relative to the arm in the direction of arrows B shown in FIG. 2. Thus, the yokes 30 can be rotated so that they lie against their associated arm 20 when the ski carrier is in its collapsed configuration.

Figure 3:
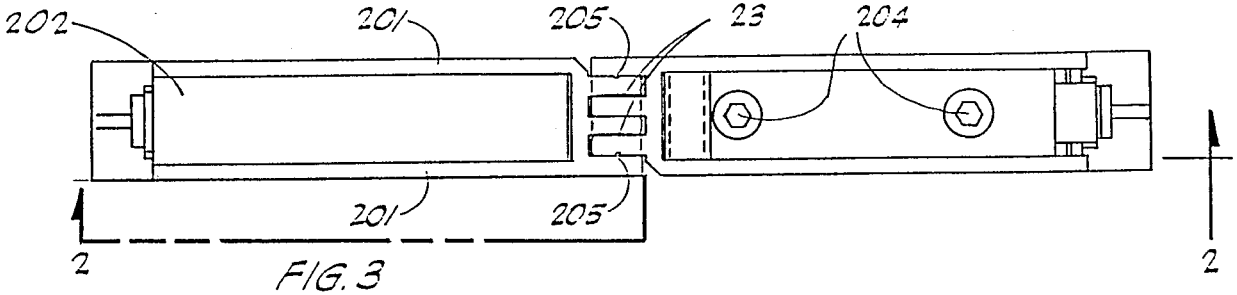
FIG. 3 is a top view of the arms of the carrier.

Each arm 20 preferably comprises an arm structure 201 and a cover plate 202 which is secured to arm structure 201 by means of pins 203 and associated receptacles 204. FIG. 3 is a top view of the arms 20 and the right side arm 20 is shown with its cover plate 202 removed to better show the internal construction of arm 20. A detecting means is provided by protrusions 205 and associated grooves and spring washer 23 so that the arms 20 detent in the expanded configuration shown in FIG. 2 and also, incidentally, in the collapsed configuration shown in FIG. 7.

Arm structure 201 includes a detent arm 206 which has a groove therein which cooperates with protrusions 305 (in the expanded configuration) and 306 (in the collapsed configuration) on yoke 30 so that yokes 30 detent in both the expanded and collapsed configurations of the carrier 10.

Each yoke 30 is preferably identical so that the yokes can be produced from a single mold and interchanged with each other during the manufacture of the ski carrier 10.

Figure 4A:
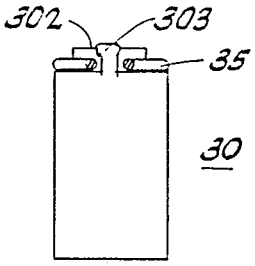
FIG. 4A is a bottom view of a yoke, with the stabilizer in section.
Figure 4:
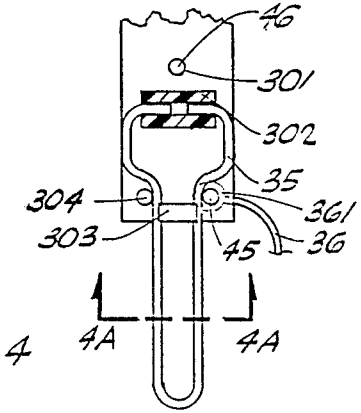
FIG. 4 is a partial side view of the ski stabilizer attached to a yoke.

Each yoke preferably has a ski torque stabilizer 35 associated therewith which is attached at fitting 302. The stabilizer can perhaps best be seen in the partial side view of FIG. 4 and in associated partial section view of FIG. 4A. The torque stabilizer 35 may be rotated between a collapsed or stored position shown on the right hand yoke 30 of FIG. 2 and an extruded or in use position shown on the left hand yoke 30 of FIG. 2. The torque stabilizers 35 separate the skis and tend to stabilize them. Each torque stabilizer is held in its extruded position by means of an associated nipple 303 which is preferably formed integral with yoke 30. The torque stabilizer is preferably formed from oil tempered wire, so that it to be eased around and effectively grasp nipple 303 when it is brought into and taken out of the extended position shown on the left hand yoke of FIG. 2.

As can be seen in FIGS. 2, 4, 5 and 7, each yoke 30 preferably has a nylon strap 36 which has a small loop 361 sewn in one end thereof, the loop surrounding a pin 45 which is disposed in one of the openings 304 in yoke 30 (two openings 304 are provided in each yoke 30 for the sake of interchangability of the yokes during manufacture). The straps are preferably about 2.5 cm (1 inch) wide and 32.5 cm (13 inches) long. The straps 36 retain the skis in place when their are being carried by the carrier 10.

A lever actuated locking device 37 is installed in each yoke 30 to lock the free ends of the straps 36 when being used to carry skis. Each locking device 37 is rotatably mounted on a pin 46, the ends of which are held by openings 301 (FIG. 4) in yokes 30. Each of the two locking devices 37 is urged to the position shown in solid lines in FIG. 5 by means of a coil spring 41, one end of which is received in an opening 372 in one side of locking device 37 and the other end of which is received in a small hole 307 in the inside wall 308 of yoke 30. A protuberance 309 on the side wall 302 prevents locking device 37 from rotating to far under the influence of spring 41.

In use, the free end 362 of straps 36 can be inserted through opening 34 in yoke 30 when the lever operated locking device 37 is manually operated so as to open it, for example, by the user catching edge 373 and pushing down on the associated lever. When released, edge 371 of locking device 73 is urged into contact with strap 36 and the bottom surface 310 of opening 34 to lock the strap in place. Of course, before inserting the strap into opening or slot 34, it would normally first be brought around the pair of skis as shown in Example 1. Locking device 37 is urged to engage strap 36 when inserted through slot 34 by means of spring 41.

Figure 6:
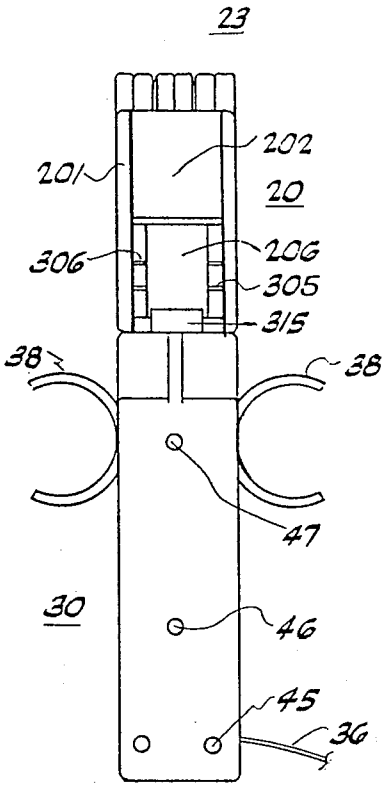
FIG. 6 depicts the clips rotated to their outward positions for receiving the ski poles.
Figure 5:
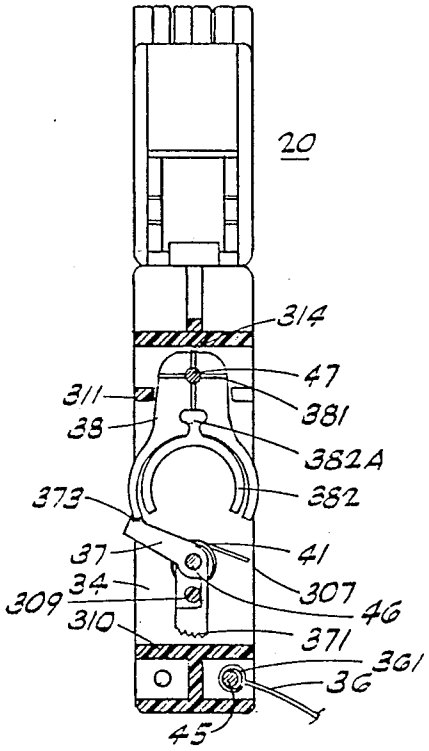
FIG. 5 is a partially cut away side elevational view of the carrier.

Each yoke 30 also preferably includes a pair of rotationally mounted pole clips 38 which are mounted on a common pin 47 fixed in yoke 30. Protrusions 311 and 312 preferably constrain clips 38 so that each can only rotate in one direction outwardly from the yoke, the direction for each clip 38 being the opposite from the other clip as is shown in FIG. 6. That is to say, the clips can be rotated to a collapsed configuration wherein they are disposed generally within the outside configuration of the yoke as shown in FIG. 5 and, in use, can be rotated in opposite directions to the position shown in FIG. 6 where the clips are disposed for receiving and grasping the skier's poles as shown in FIG. 1. A spring washer 48 is preferably used between each pair of clips 38 so that the clips are urged against the inside walls 308 of yoke 30. A detenting means includes a groove 381 in clip 38 and a pair of protuberances arranged at right angles to each other in walls 301 and 302. One of the protuberances 313 in each wall is shown in FIG. 2 engaging the associated grooves 381 in clips 38. The other protuberance is partially seen at 314 in FIG. 5. The detenting means temporarily holds the clips 38 in either the collapsed position shown in FIGS. 2 and 5 or in the extended position shown in FIG. 6.

Each pole clip 38 preferably is sized to receive and grasp a normal adult size alpine-style skiing pole. Those skilled in the art will appreciate that cross country poles and poles for children tend to have a smaller outside diameter and therefore, to accommodate such ski poles, clips 38 may be provided temporarily (and as needed) with inserts 382 which fit inside the grasping portions of pole clips 38 so as to present a smaller inside diameter to the ski pole being grasped. Inserts 382 are held in place by a snug (interference) fit between "T" element 382A and its associated opening in clip 38.

The arms, yokes, locking devices and pole clips are all preferably manufactured by molding Lexan type 3412 polycarbonate with a 20 percent fiberglass content. Thus, detent arm 206 has sufficient flexibility to provide a detenting operation in combination with protrusions 305 and 306. Likewise, the clips 38 (and their associated inserts 382—if used) have sufficient flexibility to permit their prongs to be spread to receive the skier's poles.

In order to help keep the yokes from being rotated beyond the position shown in FIG. 2, an over-rotation preventer 315 on yoke 30 is preferably provided which confronts the leading edge of detent arm 206 if the user tries to rotate the yokes 30 outwardly from the position shown in FIG. 2.

The collapsed configuration of the ski carrier shown in FIG. 7. Normally, both straps 36 would be wrapped around their associated yoke 30 and temporarily held in position by velcro or similar closure-type devices. In FIG. 7, only one of the straps 36 is shown wrapped around its associated yoke 30 for ease of illustration of the arms 20 nesting against each other and their associated yokes 30 in the collapsed configuration.

In use, arms 20 are rotated in the direction of arrow A while yokes 20 are rotated in the direction of arrow B so that the yokes and arms take the position shown in FIG. 2. Thereafter, the pairs of pole clips 38 are rotated outwardly to the positions shown in FIGS. 1 and 6. That is, the position for receiving and grasping the skier's poles. Similarly, each torque stabilizer 35 would be rotated from its stored position to the extended position while being eased over nipple 303 as shown in the left hand yoke of FIG. 2. Of course, in use, both torque stabilizers 35 would normally be arranged in the generally downward direction shown for only the left hand torque stabilizer in FIG. 2. The skis are placed so that their running surfaces confront each other on either side of the torque stabilizers and the straps 36 are brought around the pair of skis, the free ends of the straps 36 being inserted into opening 34 while at the same time the locking device 37 is operated so as to permit the passage of the free end of the strap 36 through opening 34. After the end of the strap 36 passes past the edge 371 of locking device 37, it would normally be grasped and pulled through the opening and, at the same time, the skier would normally release locking device 37 so as to permit it to perform its intended function. Of course, those skilled in the art will realize that given the direction of operation of edge 371, it permits the strap to be pulled through opening 34 so as to more tightly restrain the skis, but resists the loosening of the strap 36. Before or after strapping the skis in place, the poles can be inserted through the openings in pole clips 38 (or clip inserts 381, if used) which, as previously mentioned, then effectively grasp the poles.

The skier can then easily carry a pair of skis and the associated pair of poles in a single handed operation by simply holding on to arms 20 with a single hand, for example. After the skis have been carried, the carrier 10 can be returned to its collapsed configuration by reversing the steps mentioned above.

Having described the invention in connection with a preferred embodiment thereof, modification will doubtlessly now suggest itself to those skilled in the art. The invention is not to be limited to the disclosed embodiment, except as specifically required by the appended claims.

I claim:

1. A ski carrier comprising a pair of generally "L" shaped arms which are movably articulated to each other; a pair of yoke members, each one of which is movably articulated to one of said arms; a pole clip unit movably articulated to each yoke; and means associated with the pair of yokes for carrying a pair of skis.

2. The skier of claim 1, wherein the pair of arms are articulated to each other about a first pin for rotational movement with respect to each other and wherein each yoke is articulated to an associated arm by a second pin for rotational movement with respect to the associated arm, the second pin and the first pin being disposed in a generally parallel relationship to each other.

3. The ski carrier of claim 2, wherein the pole clip units are mounted for rotational movement about a third pin, the third pin being disposed at generally right angles to said first and second pins.

4. The ski carrier of claim 3, wherein said ski carrying means includes a pair of flexible straps, each strap being attached at one end thereof to an associated yoke, each yoke having means for receiving and temporarily locking in place the free end of the associated strap.

5. The ski carrier of claim 4 wherein each said strap is attached to an associated yoke by means of a fourth pin which is disposed parallel to said third pin.

6. The ski carrier of claim 5, wherein each locking means comprises a fifth pin and a manually operated locking device rotationally mounted on said fifth pin, said fifth pin being disposed in said yoke.

7. The ski carrier of claim 4, wherein each locking means comprises a fifth pin and a manually operated locking device rotationally mounted on said fifth pin, said fifth pin being disposed in said yoke.

8. A ski carrier having a pair of generally elongated arm units which are articulated to each other, the arm units being rotatable to a position where they lie along each other when the ski carrier is in a collapsed configuration and being rotatable therefrom when in an extended configuration; a pair of yoke units, each yoke unit being articulated to a separate arm unit, the yoke units being rotatable to lie along its associated arm unit when said ski carrier is in its collapsed configuration and being rotated therefrom when said carrier is in its extended configuration; and means associated with said yoke units for grasping a pair of skis and poles.

9. The ski carrier of claim 8 wherein said grasping means comprises a pair on pole clips on each yoke unit, said pole clips having surfaces for grasping a skiers' poles, the pole clips being rotatably mounting on the yoke units between a position in which at least the major portion of the pole grasping surfaces of said clips lie within said yoke units and a position where at least a major portion of said pole grasping surfaces extend outwardly of its yoke unit.

10. The ski carrier of claim 9, wherein each yoke unit lies along the entire length of its associated arm unit when said ski carrier is in its collapsed configuration.

11. The ski carrier of claim 10, wherein said grasping means further comprises a pair of flexible straps, each strap being attached to an associated yoke, each strap being of a sufficient length to completely encircle its associated yoke when said ski carrier is in its collapsed configuration.

12. The ski carrier of claim 9, wherein said grasping means further comprises a pair of flexible straps, each strap being attached to an associated yoke, each strap being of a sufficient length to completely encircle its associated yoke when said ski carrier is in its collapsed configuration.

13. Ski carrier comprising:

(a) a pair of arms each having a first end forming a hinge for connecting said arms together and a second end, said arms being rotatable on said hinge through approximately 180 degrees between a position wherein said arms lie adjacent to each other and a position wherein a major axis of each of said arms is essentially coincident;

(b) a pair of yoke members, each one of which is hinged to the second end of said arms, said yoke members including means for carrying a pair of skis and being rotatable between a position wherein said arms lie adjacent the associated arm and a depending position in which said yoke is disposed at approximately a 90 degree angle to the major axis of its associated arm.

14. The ski carrier of claim 13, wherein the ski carrier has a collapsed configuration wherein said pair of arms lie adjacent each other and each yoke member lies adjacent its associated arm and wherein the ski carrier has an in use configuration wherein said pair of arms are rotated approximately 180 degrees from lying adjacent each other and wherein each yoke member is rotated approximately 90 degrees from lying adjacent its associated arm.

15. The ski carrier of claim 14, further including at least one pole clip hinged to each one of said yoke members, said pole clip including a C-shaped grasping member for grasping a skier's poles, the pole clips being rotatable between a position wherein said C-shape grasping members protrude from their associated yoke members to a position wherein said C-shaped grasping members lie within said yoke members.

16. The ski carrier of claim 14, further including a pair of flexible straps, each flexible strap being attached to an associated yoke member, the strap means being of sufficient length to completely encircle its associated yoke member once that ski carrier is in its collapsed configuration, said flexible straps also being of a sufficient length to completely encircle a pair of skier's skis carried by said ski carrier when said ski carrier is in its use configuration.

17. The ski carrier of claim 13, further including at least one pole clip hinged to each one of said yoke members, said pole clip including a C-shaped grasping member for grasping a skier's poles, the pole clips being rotatable between a position wherein said C-shape grasping members protrude from their associated yoke members to a position wherein said C-shaped grasping members lie within said yoke members.

18. A ski carrier comprising a pair of generally L-shaped arms which are articulated at a first pin to each other for movement relative to a major axis of said first pin; a pair of yoke members, each one of which is articulated about a second pin to one of said arms for movement relative to a major axis of said second pin; a pole clip unit articulated at a third pin to each yoke for movement relative to the major axis of said third pin; and means associated with the pair of yokes for carrying a pair of skis.

19. The ski carrier of claim 18, wherein the first and second pins are disposed in a generally parallel relationship to each other.

20. The ski carrier of claim 19, wherein said third pin is disposed at generally right angles to said first and second pins.

* * * * *

UNITED STATES PATENT AND TRADEMARK OFFICE

CERTIFICATE OF CORRECTION

PATENT NO. : 4,842,315

DATED : June 27, 1989

INVENTOR(S) : Robert Nordmeyer, Woodland Hills, California

It is certified that error appears in the above-identified patent and that said Letters Patent is hereby corrected as shown below:

Column 6, Line 7, Change "arms" to --yokes--.

Signed and Sealed this

Twenty-seventh Day of August, 1991

*Attest:*

HARRY F. MANBECK, JR.

*Attesting Officer*

*Commissioner of Patents and Trademarks*